US005494476A

United States Patent [19]

Crawford

[11] Patent Number: 5,494,476

[45] Date of Patent: Feb. 27, 1996

[54] PROTECTIVE GUARD FOR BOARD FILE

[76] Inventor: Andrew G. Crawford, 2030 Krucker Rd., Hamilton, Ohio 45013

[21] Appl. No.: 348,322

[22] Filed: Dec. 2, 1994

[51] Int. Cl.[6] ..... B23B 17/60

[52] U.S. Cl. ..... 451/356; 451/351; 451/451; 451/344

[58] Field of Search ..... 451/356, 354, 451/351, 344, 451, 457

[56] References Cited

U.S. PATENT DOCUMENTS

| | | | |
|---|---|---|---|
| 3,793,781 | 2/1974 | Hutchins | 451/356 |
| 3,973,362 | 8/1976 | Groshans | 451/344 |
| 4,073,349 | 2/1978 | Sumida | 451/356 |

*Primary Examiner*—Bruce M. Kisliuk

*Assistant Examiner*—Eileen P. Morgan

*Attorney, Agent, or Firm*—Jack C. McGowan

[57] ABSTRACT

A protective guard for use on a pneumatic tool known as a board file which includes a handle assembly and a board assembly that reciprocates back and forth relative to the handle assembly. The board assembly is held together by a nut and bolt located near each end thereof, and the handle assembly consists of a front handle and a rear handle mounted on a housing. A pinch point exists between a forward end of the housing and the forwardmost nut and bolt that holds the board assembly together. The protective guard is mounted on the handle assembly and prevents injury to an operator by preventing his fingers or the side of his hand from inadvertently slipping into this pinch point. A platform on the protective guard covers the forwardmost nut and bolt as the board assembly reciprocates relative to the handle assembly.

6 Claims, 2 Drawing Sheets

PROTECTIVE GUARD FOR BOARD FILE

BACKGROUND OF THE INVENTION

This invention relates generally to tools commonly known as board files and, in particular, to a protective guard for a board file.

Autobody repairman use a pneumatic tool known as a board file when repairing an automobile body. After dents in an automobile body have been filled with epoxy, the board file is used to sand the epoxy so that it blends in with the surrounding sheet metal before repainting.

A board file consists of a handle assembly connected to a board assembly which carries sandpaper. The sandpaper is affixed to the board assembly by clips and by adhesive provided on one side of the sandpaper. The handle assembly includes a front handle and a rear handle so that an operator holds the tool with two hands. The board assembly is held together by a nut and bolt located near each end of the board assembly. The handle assembly has a fitting which is connected to a source of compressed air so that the board assembly will be reciprocated back and forth relative to the handle assembly. A variable speed trigger on the rear handle of the handle assembly controls the rate of reciprocation of the board assembly.

A pinch point exists between a forward end of the handle assembly and the forwardmost nut and bolt that holds the board assembly together. During operation of the tool, an operator can inadvertently permit one of his fingers or the side of his hand to slip into this pinch point, thereby resulting in an injury to the operator.

U.S. Pat. Nos. 2,494,306 to Morvey; 2,660,974 to Swain; and 3,121,938 to Lind et al disclose protective guards for attachment to hand tools but these guards are not adaptable for use on a board file. U.S. Pat. No. 3,510,989 to Tolle discloses a power tool with a guard partially surrounding a rotatable cylinder which carries sandpaper. The guard disclosed by Tolle does not solve the above-mentioned problem encountered with a board file.

SUMMARY OF THE INVENTION

The present invention provides an improvement for use in combination with a board file wherein the board file includes a handle assembly and a board assembly which reciprocates back and forth relative to the handle assembly. The board assembly includes a plate and a board held together by a nut and bolt located near each end of the board assembly. The handle assembly includes a front handle and a rear handle mounted on a housing.

The improvement comprises a protective guard mounted on the handle assembly for covering the forwardmost nut and bolt that holds the plate and the board together as the board assembly reciprocates back and forth relative to the handle assembly. In its preferred embodiment, the protective guard comprises a pair of legs detachably connected to the housing and a platform connected between the legs. The platform covers a pinch point which exists between a forward end of the housing and the forwardmost nut and bolt. The legs of the protective guard may be attached to the housing by screws.

DESCRIPTION OF THE PREFERRED EMBODIMENT

Figure 1:
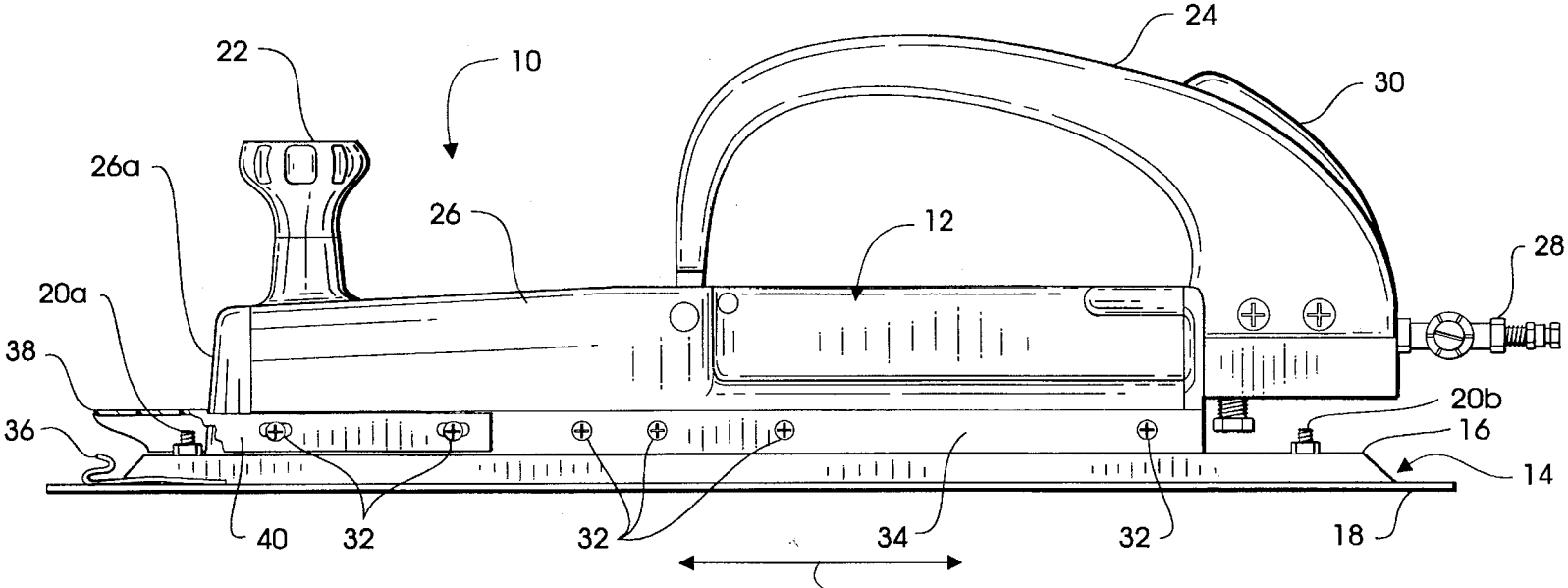
FIG. 1 is a side elevational view of a board file with a protective guard according to the preferred embodiment of the present invention installed.
Figure 2:
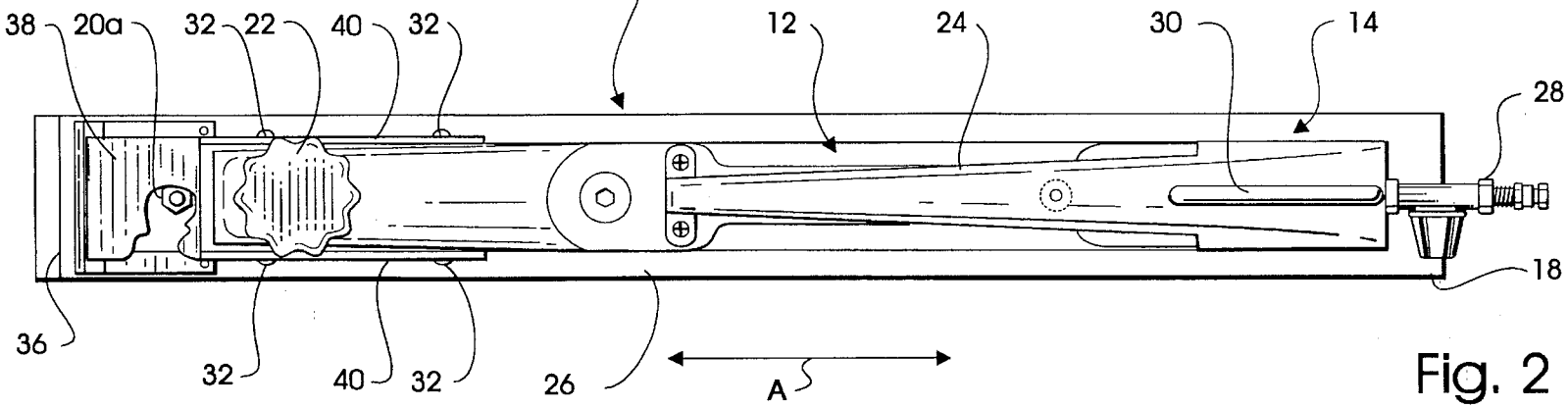
FIG. 2 is a top plan view of the board file shown in FIG. 1 with the protective guard installed.

Referring to FIGS. 1 and 2, a pneumatic tool known as a board file is generally designated 10 and is of a general type of tool used when repairing an automobile body. The tool 10 includes a handle assembly 12 and a board assembly 14 that reciprocates back and forth with respect to the handle assembly 12 in a direction indicated by arrow A.

The board assembly 14 consists of an elongated plate 16 and a rectangular board 18 held together by a nut and bolt **20*a*, 20*b* located near each end of the board assembly 14. The handle assembly 12 comprises a front handle 22 and a rear handle 24 mounted on a housing 26. A fitting 28 on the handle assembly 12 is adapted for connection to a source of compressed air, and a variable speed trigger 30 is provided on the rear handle 24 for controlling a piston (not shown) slidably disposed inside the housing 26 that causes reciprocation of the board assembly 14 in the direction of arrow A. A plurality of screws 32 are located in each side of the handle assembly 12 and secure a strip 34 to each side of the housing 26**.

When the tool 10 is prepared for use, a rectangular piece of sandpaper (not shown) will be affixed to the board 18 by adhesive on one side of the sandpaper. A clip 36 mounted on the board 18 will also be utilized to affix the sandpaper to the board 18. The fitting 28 will be connected to an air compressor.

During operation of the tool 10, the board assembly 14 reciprocates back and forth relative to the handle assembly 12 in the direction of arrow A while an operator holds the tool 10 with two hands by utilizing the front and rear handles 22, 24. The strips 34 each have a lower flange (not shown) which cooperate in guiding the plate 16 as the board assembly 14 reciprocates. A pinch point exists between the forward end **26*a* of the housing 26 and the forwardmost nut and bolt 20*a***. If an operator inadvertently permits one of his fingers or the side of his hand to slip into this pinch point, he could be injured.

Figure 3:
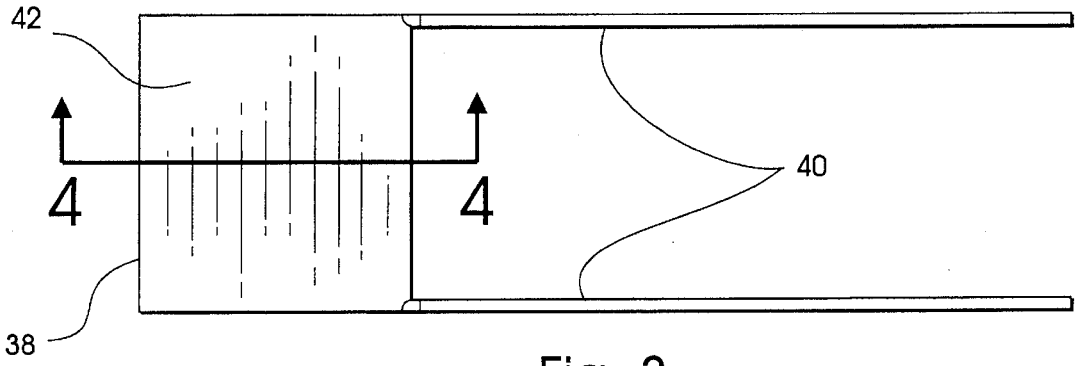
FIG. 3 is an enlarged top plan view of the protective guard shown in FIGS. 1 and 2.
Figure 4:
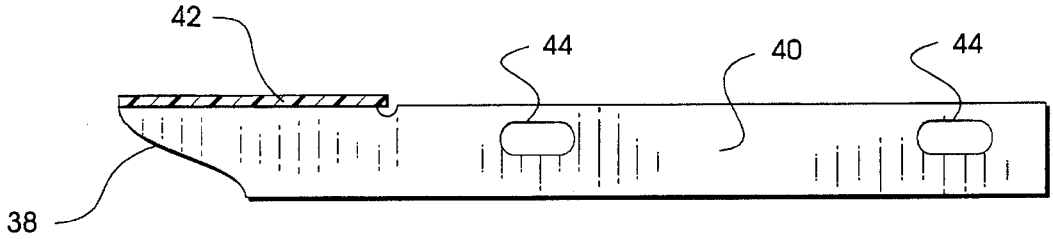
FIG. 4 is a side elevational view of the protective guard shown in FIG. 3.
Figure 5:
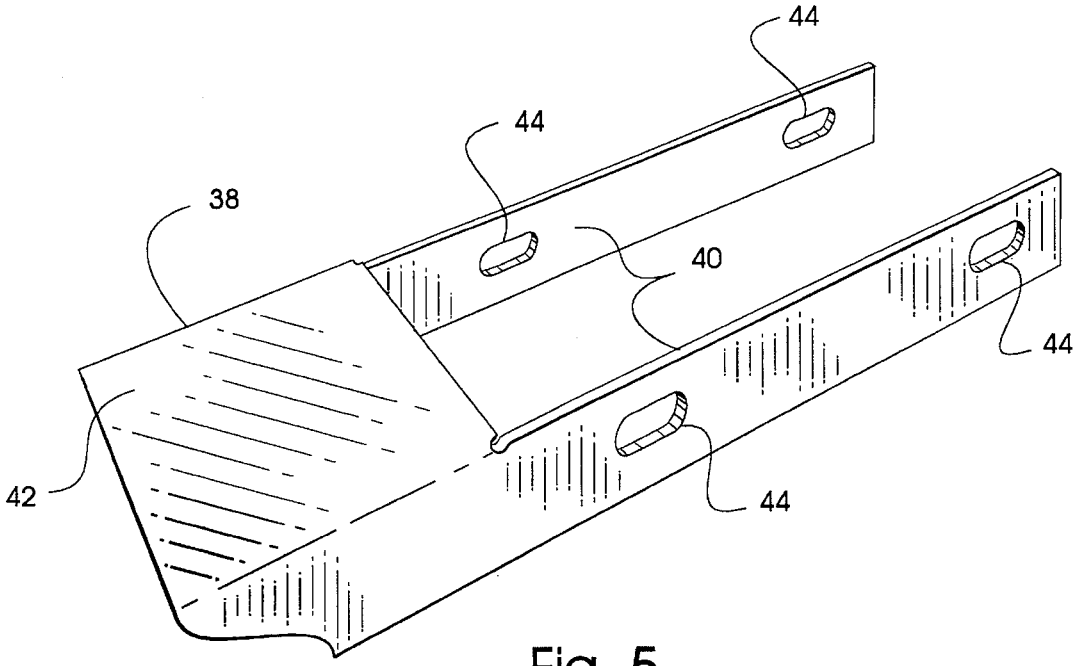
FIG. 5 is a perspective view of the protective guard shown in FIGS. 3 and 4.

In order to prevent such injury, a protective guard 38 is mounted on the handle assembly 12 in a manner which prevents access to the aforementioned pinch point. As best seen in FIGS. 3–5, the protective guard 38 has a pair of legs 40 and a platform 42 connected between the legs 40. Holes 44 in each of the legs 40 are positioned to receive two of the screws 32 to thereby attach the legs 40 to the housing 26. The holes 44 are elongated to permit adjustment of the protective guard 38. When the board assembly 14 reciprocates, the forwardmost nut and bolt **20*a* is covered by the platform 42 thereby preventing access to the pinch point. With the protective guard 38 mounted on the handle assembly 12, the operator's fingers and hand cannot slip into the pinch point. The rearwardmost nut and bolt 20*b* is covered by the rear handle 24**.

It will be understood that the protective guard 38 of the present invention is not limited for use on the particular type of board file shown in FIGS. 1 and 2 but may be used on other types of board files.

What is claimed is:

1. In combination with a board file wherein said board file includes a handle assembly and a board assembly which reciprocates back and forth relative to said handle assembly, said board assembly including a plate and a board held together by a nut and bolt located near each end of said board assembly, said handle assembly including a front handle and a rear handle mounted on a housing, an improvement comprising:

a protective guard mounted on said handle assembly for covering the forwardmost nut and bolt that holds said plate and said board together as said board assembly reciprocates back and forth relative to said handle assembly wherein said protective guard comprises a pair of legs detachably connected to said housing and a platform connected between said legs.

2. The improvement of claim 1, wherein said legs of said protective guard are attached to said housing by screws.

3. The improvement of claim 1, wherein said platform covers said forwardmost nut and bolt thereby preventing access to a pinch point existing between a forward end of said housing and said forwardmost nut and bolt.

4. The improvement of claim 3, wherein said legs of said protective guard have holes for receiving said screws.

5. The improvement of claim 4, wherein said holes are elongated to permit adjustment of said protective guard.

6. In combination with a board file wherein said board file includes a handle assembly and a board assembly which reciprocates back and forth relative to said handle assembly, said board assembly including a plate and a board held together by a nut and bolt located near each end of said board assembly, said handle assembly including a front handle and a rear handle mounted on a housing, said rear handle covering the rearwardmost nut and bolt, an improvement comprising:

a protective guard mounted on said handle assembly for covering the forwardmost nut and bolt that holds said plate and said board together as said board assembly reciprocates back and forth relative to said handle assembly; and said protective guard including a pair of legs detachably connected to said housing and a platform connected between said legs, said platform preventing access to a pinch point existing between a forward end of said housing and said forwardmost nut and bolt.

* * * * *